United States Patent [19]

Torigoe et al.

[11] Patent Number: 4,581,787

[45] Date of Patent: Apr. 15, 1986

[54] VACUUM CLEANER

[75] Inventors: Masao Torigoe, Itami; Tadafumi Kubo, Osaka, both of Japan

[73] Assignee: Matsushita Electric Industrial Co., Ltd., Japan

[21] Appl. No.: 662,077

[22] Filed: Oct. 18, 1984

[30] Foreign Application Priority Data

Oct. 19, 1983 [JP] Japan ..... 58-195628
Nov. 9, 1983 [JP] Japan ..... 58-210123

[51] Int. Cl.[4] ..... A47L 5/30

[52] U.S. Cl. ..... 15/351; 15/390; 15/391

[58] Field of Search ..... 15/350, 351, 389, 390, 15/391

[56] References Cited

U.S. PATENT DOCUMENTS 1,485,188 2/1924 Hoff ..... 15/389
4,446,595 5/1984 Nakada ..... 15/390

FOREIGN PATENT DOCUMENTS 205447 9/1959 Austria ..... 15/389
456984 11/1936 United Kingdom ..... 15/389

*Primary Examiner*—Chris K. Moore
*Attorney, Agent, or Firm*—Lowe, King, Price & Becker

[57] ABSTRACT

An upright vacuum cleaner includes a floor nozzle having a rotatable brush housed therein for operative contact with a surface to be cleaned, a main cleaner assembly coupled with the floor nozzle and accommodating a motor-driven fan having a motor shaft and a filter therein, a flexible power transmitting shaft for transmitting rotative power from the motor-driven fan to the rotatable brush along a power transmitting path between the motor shaft and the rotatable brush, and an intermediate power transmitting mechanism including a torque limiter mechanism disposed in the power transmitting path for cutting off power transmission from the motor shaft to the rotatable brush when the rotatable brush is subjected to a torque greater than a preset torque.

21 Claims, 10 Drawing Figures

VACUUM CLEANER

BACKGROUND OF THE INVENTION

1. Field of the Invention

The present invention relates to an upright vacuum cleaner having a main cleaner assembly to which a floor nozzle having a rotatable brush or agitator is coupled.

2. Description of the Prior Art

Prior upright vacuum cleaners include, among other things, a motor-driven air blower or fan in a main cleaner assembly for drawing in dust and dirt, and a motor in a floor nozzle for rotating a rotatable brush or agitator. Since the conventional upright vacuum cleaner requires two separate motors, it has been disadvantageous in that it is heavy and costly, and the floor nozzle itself is large in size, rendering cleaning a tedious and time-consuming operation.

To eliminate the above shortcomings, it has been proposed to have the motor-driven fan positioned in a lower portion of the main cleaner assembly, with the agitator driven by a belt trained around a rotating shaft of the motor-driven fan. However, the proposed vacuum cleaner suffers the following difficulties:

Since it is necessary to draw air from the floor nozzle up to an upper portion of the main cleaner assembly, because of the low position of the motor-driven fan, an air suction passage through the main cleaner assembly is necessarily long and presents increased resistance to air flow, reducing the ability of the vacuum cleaner to draw dust and dirt. Another drawback is that the motor-driven fan has an axis extending transversely across the main cleaner assembly, which is therefore of increased width. The wide main cleaner assembly cannot be handled with ease for cleaning.

SUMMARY OF THE INVENTION

It is an object of the present invention to provide a vacuum cleaner which is compact, of high performance, and easily handled in use.

A vacuum cleaner according to the present invention includes a floor nozzle housing a rotatable brush or agitator therein, a main cleaner assembly coupled to the floor nozzle and accommodating a motor-driven air blower or fan and a filter, and a shaft for transmitting rotative power from the motor-driven fan to the rotatable brush through an intermediate power transmitting mechanism. Since the motor-driven fan disposed in the main cleaner assembly is used for both drawing dust and dirt and driving the rotatable brush, the vacuum cleaner is small in size and lightweight in its entirety, and can be handled with increased ease. The motor-driven fan has its suction side located downwardly with a dust collection chamber therein, so that an air suction passage from the floor nozzle up to the dust collection chamber is shortened.

BRIEF DESCRIPTION OF THE DRAWINGS

The present invention will be described in detail by way of illustrative example with reference to the accompanying drawings, in which.

DETAILED DESCRIPTION

Figure 1:
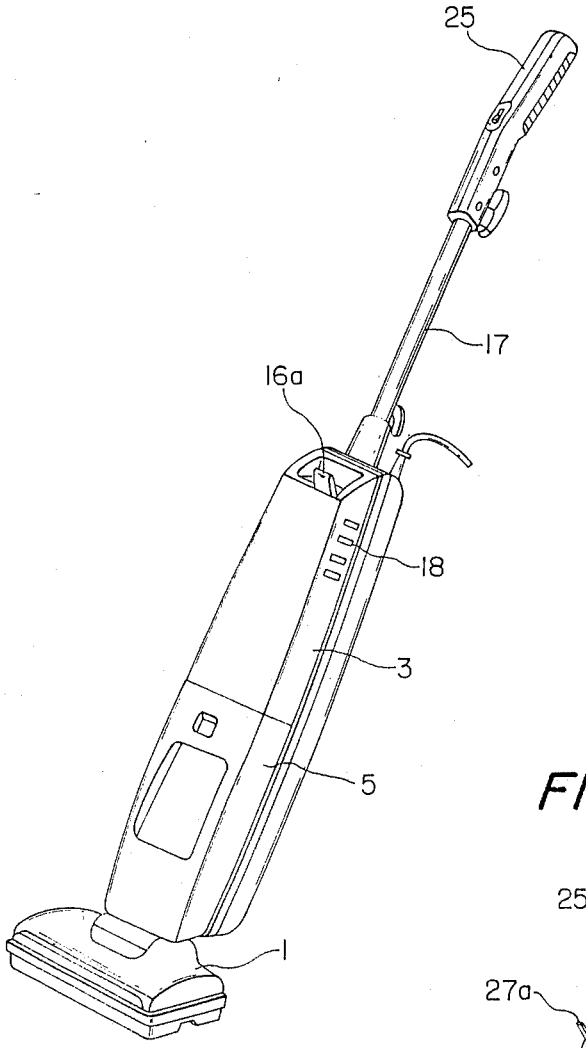
FIG. 1 is a perspective view of a vacuum cleaner according to an embodiment of the present invention.

Like or corresponding parts are denoted by like or corresponding reference characters throughout the views.

Figure 2:
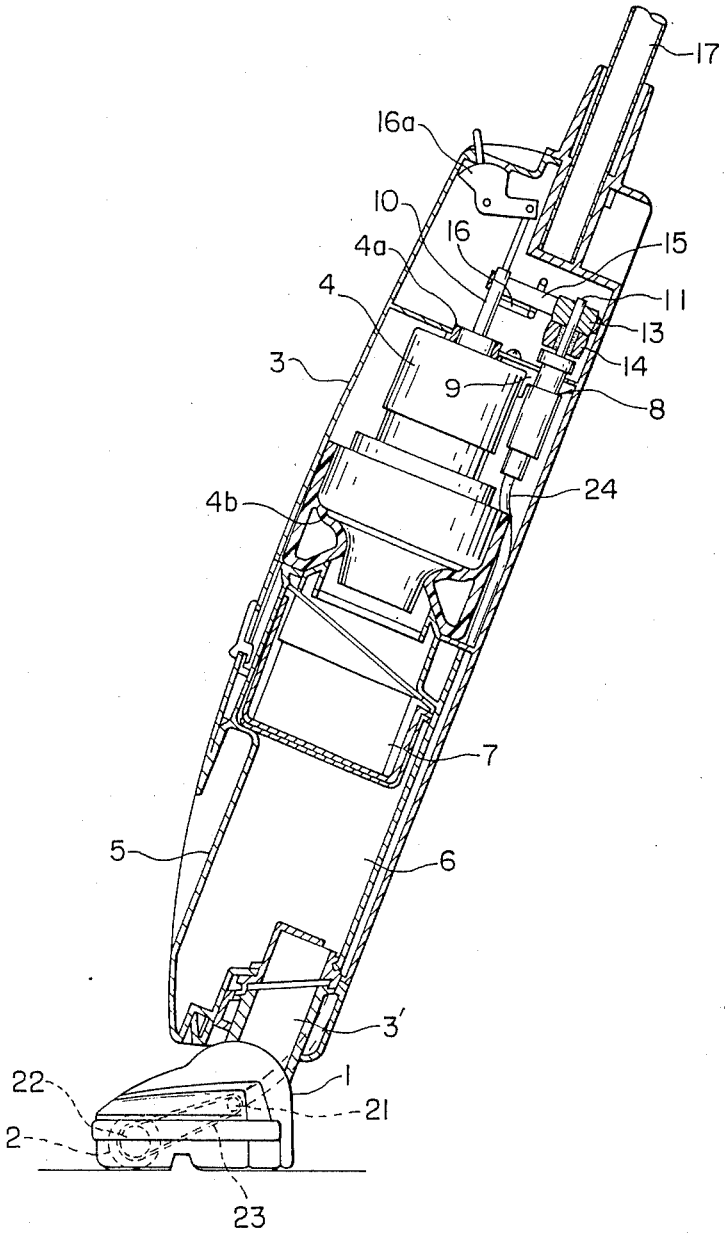
FIG. 2 is a sectional side elevational view of the vacuum cleaner shown in FIG. 1.
Figure 3:
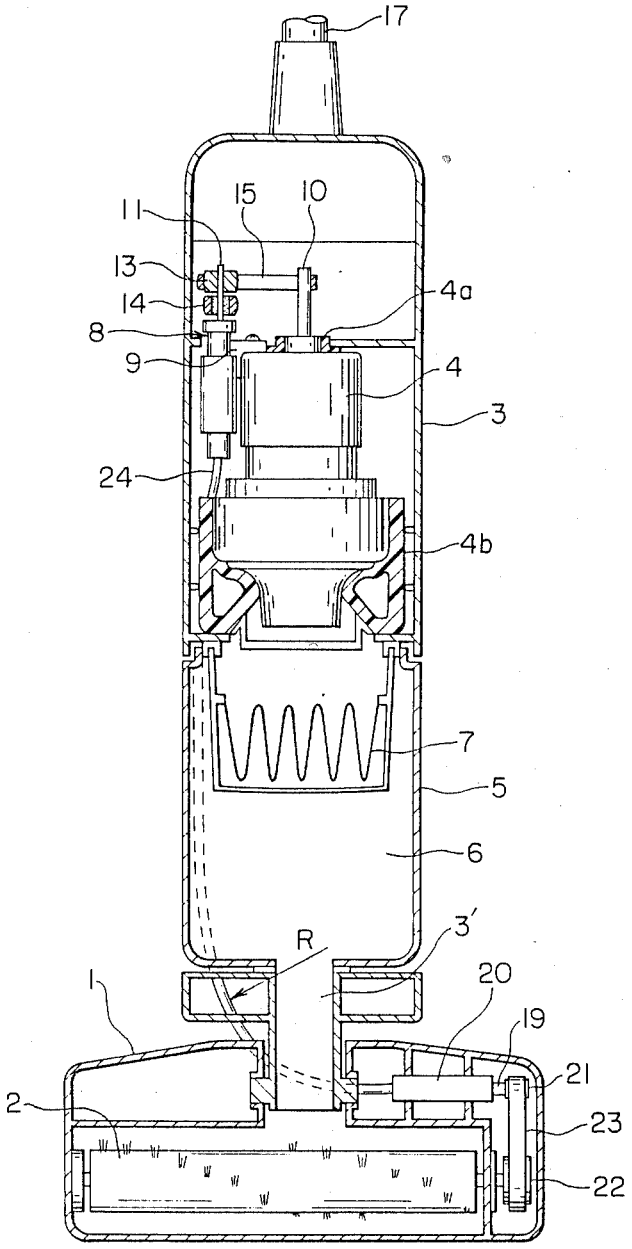
FIG. 3 is a sectional front elevational view of the vacuum cleaner of FIG. 1.
Figure 4:
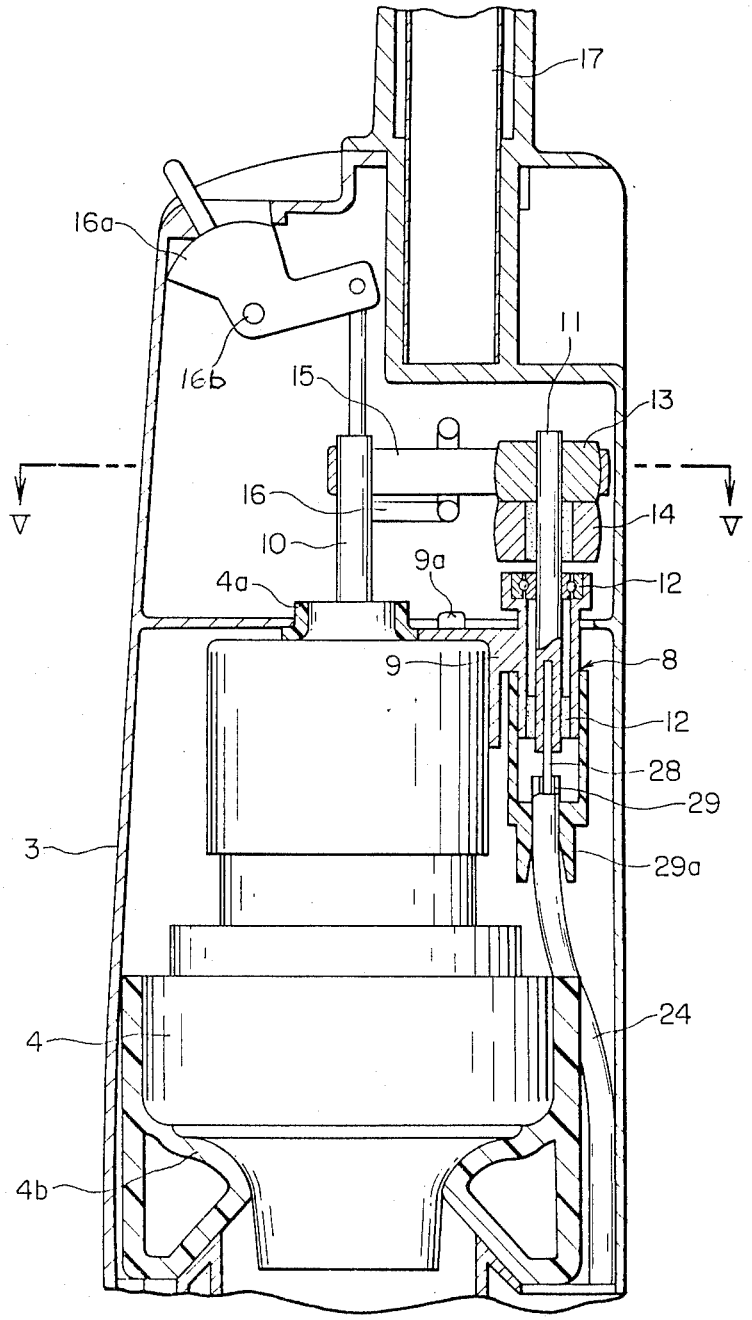
FIG. 4 is an enlarged fragmentary sectional side elevational view of the vacuum cleaner of FIG. 1.

FIGS. 1 through 5 illustrate a vacuum cleaner according to an embodiment of the present invention. As shown in FIGS. 1 through 3, the vacuum cleaner includes a floor nozzle 1 housing a rotatable brush or agitator 2, and a main cleaner assembly 3 of a substantially square cross section (FIG. 5) coupled vertically and angularly movable to the floor nozzle 1 through a coupling cylinder 3'. The main cleaner assembly 3 accommodates a motor-driven air blower or fan 4 supported by vibroisolating members 4*a*, 4*b* as of rubber in an upper portion of the main cleaner assembly 3. The main cleaner assembly 3 has a dust collection chamber 6 positioned in a lower suction side of the motor-driven fan 4, the dust collection chamber 6 being opened and closed by a cover 5 and housing a filter 7 adjacent to the motor-driven fan 4. An intermediate power transmitting mechanism 8 including a clutch is disposed in the main cleaner assembly 3 at one of four corners of the the main cleaner assembly 3 of substantially square cross section. The intermediate power transmitting mechanism 8 has an attachment base 9 fastened by a bolt 9*a* on the motor-driven fan 4, as shown in FIGS. 2 and 4. The motor-driven fan 4 includes a motor shaft 10 extending upwardly.

As shown in FIG. 4, the intermediate power transmitting mechanism 8 is composed of bearings 12 in which a clutch shaft 11 parallel to the motor shaft 10 is rotatably journalled, a drive pulley 13 fixed on the clutch shaft 11, and an idler pulley 14 rotatably mounted on the clutch shaft 11. The bearings 12 are mounted in the attachment base 9. A flat belt 15 is trained under an adjusted tension around the motor shaft 10 and selectively around the pulleys 13 or 14. The belt 15 can axially be shifted to pulley 13 or 14 by means of a belt shifter 16 including an actuator lever 16*a* pivotably mounted by a pivot pin 16*b* in an upper front portion of the main cleaner assembly 3. As shown in FIGS. 1 through 4, a handle 17 projects upwardly from an upper end of the main cleaner assembly 3. In FIG. 1, a grip 25 is fixed to an upper end of the handle 17. The main cleaner assembly 3 has air outlet ports 18 defined in a side wall thereof.

As best illustrated in FIG. 3, the floor nozzle 1 accommodates therein a bearing 20 in which a pulley shaft 19 parallel to the agitator 2 is rotatably journalled, the pulley shaft 19 having a pulley 21 on an end thereof, a pulley 22 mounted on an end of the agitator 2, and a flat belt 23 trained around the pulleys 21, 22. A flexible power transmitting shaft 24 has one end coupled to the clutch shaft 11 in substantial alignment therewith and an opposite end to the pulley shaft 19 in substantial alignment therewith. The flexible power transmitting shaft 24 extends through the corner of the main cleaner assembly 3 in which the intermediate power transmitting mechanism 8 is located, is arcuately curved in its portion extending substantially between the main cleaner assembly 3 and the floor nozzle 1, and lies in a rear side portion of the floor nozzle remote from the corner of the main cleaner assembly 3 accommodating the shaft 24 and in which rear side portion the shaft 24 is connected to the pulley shaft 19. Therefore, rotative power from the clutch shaft 11 can be smoothly be transmitted via the shaft 24 to the pulley shaft 19 without imposing undue load on the shaft 24.

Operation of the vacuum cleaner thus constructed is as follows: When the belt 15 is shifted to the drive pulley 13 and the motor-driven fan 4 is actuated, rotative power from the motor-driven fan 4 is transmitted through the motor shaft 10, the belt 15, the drive pulley 13, and thence through the clutch shaft 11 and the power transmitting shaft 24 to the pulley shaft 19 in the floor nozzle 1. Then, the rotative power is transmitted from the pulley 21 through the belt 23 and the pulley 22 to the agitator 2 to thereby rotate the same about its own axis.

Dust is now agitated by the rotating agitator 2 from a material being cleaned such as a rug into the floor nozzle 1 from which the dust is carried by a suction air stream into the dust collection chamber 6.

When a bare floor such as a wooden floor is to be cleaned with the vacuum cleaner, the lever 16*a* is turned to depress the belt shifter 16 to shift the belt 15 from the drive pulley 13 to the idler pulley 14. Rotative power is then transmitted from the motor shaft 10 through the belt 15 to the idler pulley 14. Since the idler pulley 14 rotates idly on the clutch shaft 11, the clutch shaft 11 is not rotated, and hence the agitator 2 is not rotated.

The intermediate power transmitting mechanism 8 will be described in detail. When the agitator 2 is stopped due for example to biting engagement with a rug while cleaning the latter, the motor-driven fan 4 would be stopped and subjected to the danger of a burnout. Therefore, it is necessary to interrupt the rotative power from the motor-driven fan 4 when the agitator 2 is forcibly stopped. To meet such a requirement, the intermediate power transmitting mechanism 8 has a torque limiting capability for cutting off power transmission when a torque greater than a predetermined level is applied to the agitator 2. More specifically, while the agitator 2 is in rotation, the belt 15 is trained around the motor shaft 10 and the drive pulley 13. When the agitator 2 is forcibly stopped, the drive pulley 13 is also brought to a stop. Since the belt 15 is subjected to an adjusted tension, a slippage occurs between the motor shaft 10 and the belt 15, thus allowing the motor shaft 10 to be continuously rotated without being stopped.

The clutch shaft 11, the bearings 12, the drive pulley 13, and the idler pulley 14 of the intermediate power transmitting mechanism 8 are assembled together in fixed positional relationship to the attachment base 9 which is fastened to the motor-driven fan 4. The interaxial distance of the belt 15 between the motor shaft 10 and the pulley 13 or 14 can be adjusted to a nicety for suitably tensioning the belt 15 by positioning the attachment base 9 with respect to the motor-driven fan 4. In addition, the intermediate power transmitting mechanism 8 can easily be assembled in position.

With the foregoing arrangement, dust and dirt can be drawn and the agitator 2 can be driven by the single motor. Therefore, the floor nozzle 1 may be small in size and the main cleaner assembly 3 may be small in width. Since the dust collection chamber 6 is located below the motor-driven fan 4, an air suction passage from the floor nozzle 1 up to the dust collection chamber 6 is short.

The intermediate power transmitting mechanism 8 and the power transmitting shaft 24 are disposed together in series in one corner of the main cleaner assembly 3, and hence require no excessive installation space in the main cleaner assembly 3, a feature which contributes to a further reduction in the width and weight of the main cleaner assembly 3. Furthermore, since there is no sharp bend in the flexible power transmitting shaft 24 at its connecting ends and anywhere intermediate therebetween, any loss in the power transmitted by the shaft 24 is held to a minimum.

The intermediate power transmitting mechanism 8 also has a speed-change capability achieved by the belt 15 in addition to the clutch and torque limiter capabilities.

The vacuum cleaner illustrated in FIGS. 1 through 5 has the following advantages:

The vacuum cleaner is lightweight reduced cost since dust and dirt can be collected and the agitator 2 can be driven by a single motor. Since the intermediate power transmitting mechanism 8 has a torque limiter capability, the vacuum cleaner can be used with safety. Because the floor nozzle 1 is small in size and the main cleaner assembly 3 is small in width, the vacuum cleaner can easily be handled in cleaning operation. The air suction passage from the floor nozzle to the dust collection chamber is short and hence produces only a small pressure loss, with the result that the vacuum cleaner is of high dust drawing performance. No special space, other than the space defined in and by the shape of the main cleaner assembly 3, is required for the installation of the intermediate power transmitting mechanism 8 and the power transmitting shaft 24. This is also effective in allowing the main cleaner assembly 3 to be small in width, lightweight, and easy to use. Since the power transmitting shaft 24 is connected in series to the intermediate power transmitting mechanism 8, is curved gradually arcuately, and connected to the pulley shaft 19 in substantial alignment therewith, any loss in rotative power transmitted by the shaft 24 is minimized. Therefore, the vacuum cleaner is highly effifcient in operation.

Figure 6A:
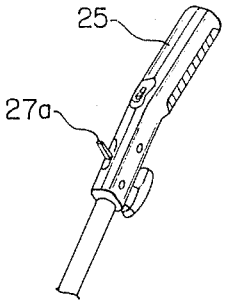
FIG. 6A is a fragmentary perspective view of a grip having a control lever.

A vacuum cleaner according to another embodiment will be described with reference to FIG. 6. A shift lever 26 is pivotably connected to the belt shifter 16 and has one end pivotably coupled to a control rod 27 extending through the handle 17 and connected to a control lever 27*a* (FIG. 6A) mounted on the grip 25. When the shift lever 26 is in the solid-line position of FIG. 6, the belt 15 is trained around the drive pulley 13 to rotate the agitator 2 (FIGS. 2 and 3) in response to rotation of the motor-driven fan 4. When the shift lever 26 is turned to the broken-line position, the belt 15 is shifted to the idler pulley 14 to stop the agitator.

Figure 6:
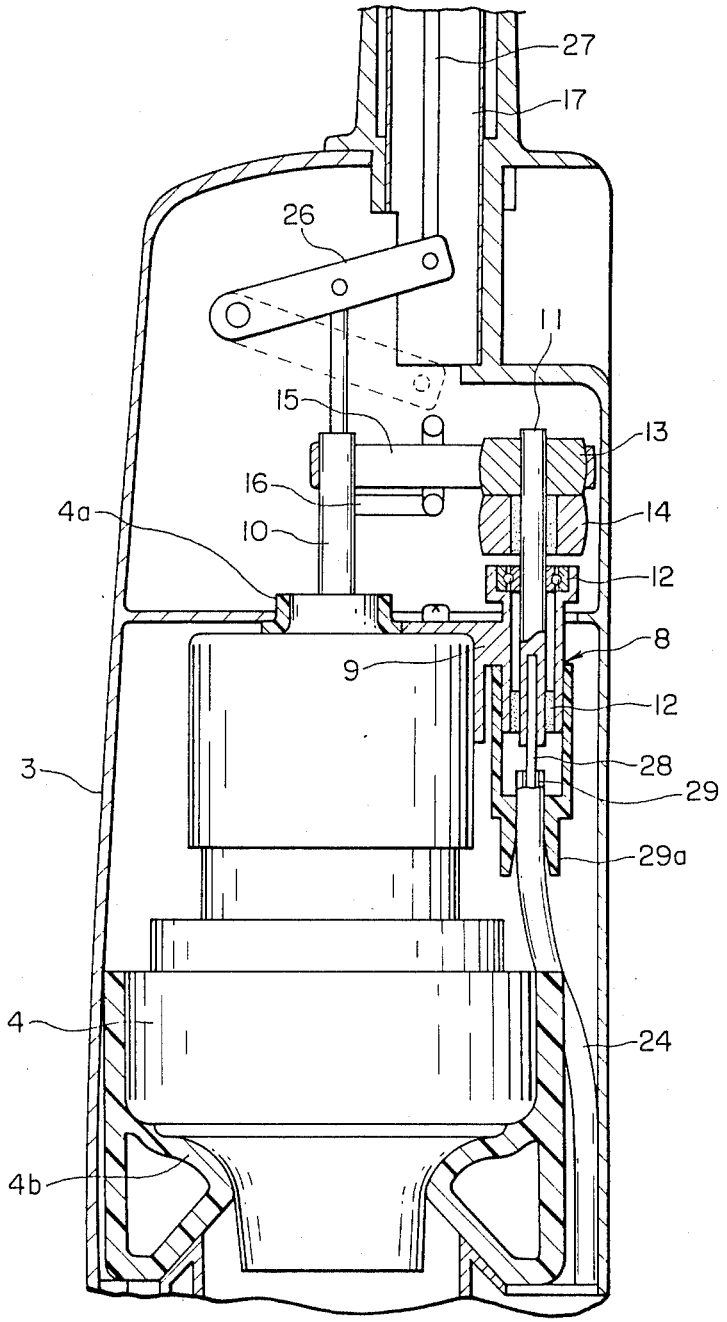
FIG. 6 is an enlarged fragmentary sectional side elevational view of a vacuum cleaner according to another embodiment of the present invention.

With the construction of FIG. 6, the agitator can be rotated and stopped by operating the control lever on the grip 25, and hence cleaning modes can easily be selected on the grip 25. The control lever on the grip 25 may be operatively associated with an ON-OFF switch coupled with a power supply for the motor-driven fan 4. Other arrangements may be employed to actuate the belt shifter 16 in response to operation of the control lever on the grip 25. For example, the belt shifter 16 may be actuated by a solenoid which is energizable and de-energizable by operation of the control lever.

Figure 7:
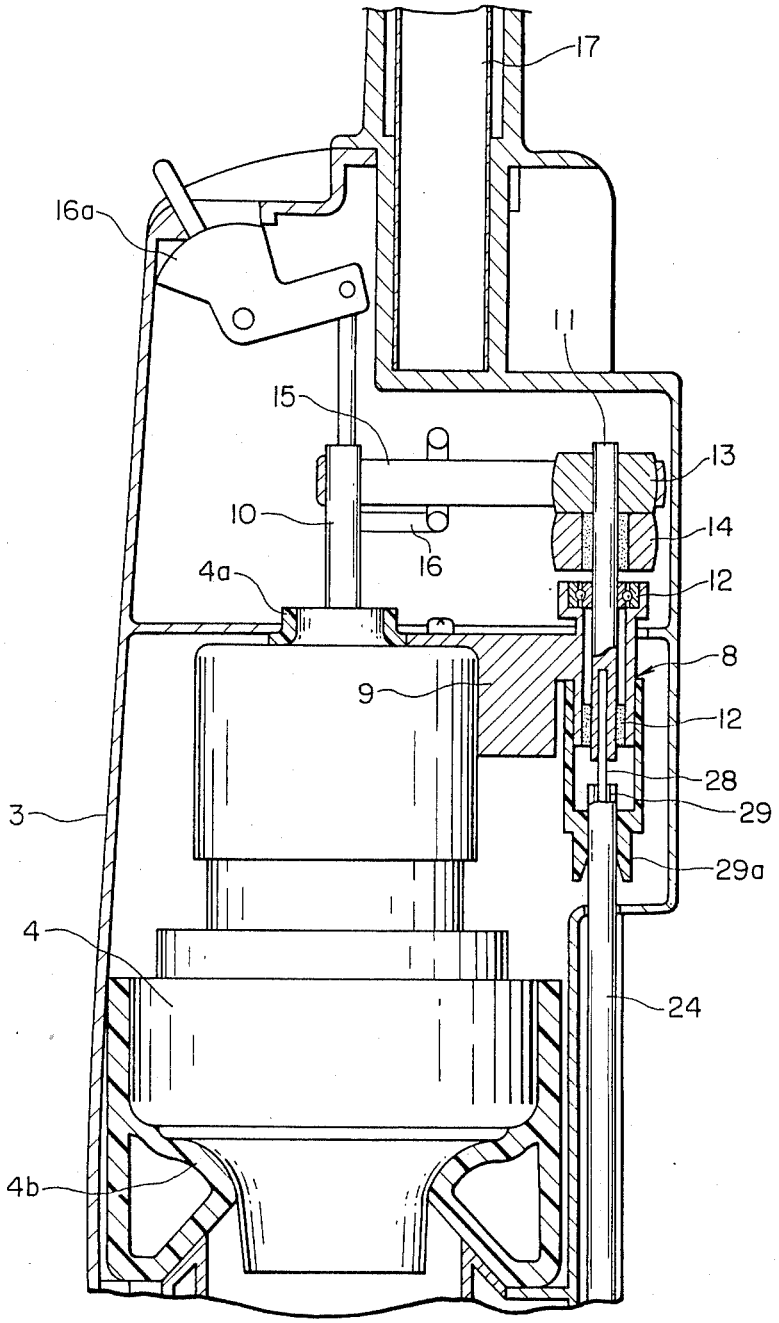
FIG. 7 is an enlarged fragmentary sectional side elevational view of a vacuum cleaner according to still another embodiment of the present invention.

FIG. 7 illustrates still another embodiment of the present invention. The intermediate power transmitting mechanism 8 shown in FIG. 7 is of substantially the same construction as that of the intermediate power transmitting mechanism according to the first embodiment shown in FIGS. 1 through 5. The power transmitting shaft 24 is coupled to the clutch shaft 11 of the intermediate power transmitting mechanism 8 within the main cleaner assembly 3. The power transmitting shaft 24 has a substantial elongate portion, below the intermediate power transmitting mechanism 8, which is positioned outside of the main cleaner assembly 3. The arrangement of FIG. 7 is advantageous for various reasons. Since the power transmitting shaft 24 does not extend through the dust collection chamber in the main cleaner assembly 3, it is not necessary to provide a hermetical seal within the dust collection chamber with respect to the shaft 24. The main cleaner assembly 3 can therefore be constructed of simple parts and assembled with ease. As the substantial length of the shaft 24 is disposed outside of the main cleaner assembly 3, these components can easily be assembled. Should the shaft 24 be cut off or otherwise damaged, it can easily be detached for repair or replacement, and the repaired or replaced shaft 24 can easily be mounted in place.

The power transmitting shaft 24 will be described in greater detail with reference to FIGS. 2 through 4. To give the motor-driven fan 4 which is relatively small in size a sufficient suction capability, the motor shaft 10 is rotated at 20,000 rpm. The drive pulley 13 operatively coupled by the belt 15 to the motor shaft 10 is rotated at 8,000 rpm due to a speed reduction ability of the belt 15. The power transmitting shaft 24 is composed of an inner wire 28 coupled to the clutch shaft 11 and an opposite end to the pulley shaft 19. The inner wire 28 is therefore rotated at 8,000 rpm. For cleaning a rug thoroughly with the agitator 2, the agitator 2 is required to be rotated at about 4,000 rpm. The pulley 21, the belt 23, and the pulley 22 jointly serve as a speed reducer to reduce the speed of rotation of the pulley shaft 19 by half and transmits the slowed rotation to the agitator 2, and also as a torque limiter mechanism identical in function to the torque limiter mechanism of the intermediate power transmitting mechanism 8.

The above-specified numbers of rpm are determined by the various components, especially the power transmitting shaft 24.

Where the inner wire 28 has an outside diameter of 2.5 mm, the power transmitting shaft 24 is generally capable of transmitting a torque up to 0.4 kg - cm and can be curved to an arcuate shape having a radius of curvature R (FIG. 3) greater than 60 mm as can be seen from the following table:

| Allowable inner wire performance | | |
|---|---|---|
| Outside dia. | Radius of curvature | Transmitted torque |
| 2 mm | >50 mm | <0.13 kg - cm |
| 2.5 mm | >60 mm | <0.4 kg - cm |
| 3.2 mm | >100 mm | <1.2 kg - cm |

The power required for rotating the agitator 2 which has double rows of bristles and an outside diameter of 50 mm is 0.8 kg - cm or 32.9 W measured at 4,000 rpm. Therefore, the load torque of the inner wire 28 is 0.4 kg - cm.

A durability test was conducted in which a rug was cleaned under the above condition with the inner wire 28 of 2.5 mm across, curved at a radius of curvature R of 60 mm (the main cleaner assembly 3 had a width of 120 mm and the floor nozzle 1 had a width of 350 mm). It was confirmed in the test that the inner wire 28 had a service life of at least 1,000 hours.

Where the power transmitting shaft 24 is to be disposed within or substantially outside of the main cleaner assembly 3, it is important that the shaft 24 be housed in the compact main cleaner assembly 3 with the radius of curvature R as small as possible. To meet such a requirement, the inner wire 28 should be as thin as possible to reduce the radius of curvature R. However, the torque that can be transmitted by the shaft 24 is reduced as shown in the above table. It is preferable therefore to use the inner wire 28 which is capable of transmitting a small torque, rotated at a high speed, and as thin as possible. These conditions for use of the inner wire have been found by carrying out many experiments, based on which the foregoing specific conditions have been achieved.

In actual use, the agitator 2 frequently bites into the rug and is locked thereby against rotation. As described earlier, the intermediate power transmitting mehcanism 8 has a torque limiter mechanism for preventing the motor from suffering a burnout if the agitator 2 is locked. The allowable torque that can be transmitted by the inner wire 28 is 0.4 kg - cm, as described, which is about 1/10 of a torque by which the inner wire 28 can be cut off. When the torque transmitted by the inner wire 28 exceeds 1 kg - cm immediately before the agitator 2 is locked, the intermediate power transmitting mechanism 3 with the torque limiter capability is disabled to stop the inner wire 28, and no more torque is transmitted by the inner wire 28. The inner wire 28 is thus protected from damage.

There is a clearance between the inner wire 28 and the outer wire 29 with grease filled in the clearance for allowing the inner wire 28 to rotate smoothly in the outer wire 29. When the inner wire 28 is rotated at a high speed, however, sounds are produced due to sliding engagement between the inner and outer wires 28, 29. In addition, since the agitator 2 is subjected to a varying load, the torque imposed on the agitator 2 also varier, and the inner wire 28 vibrates. To prevent such noise and vibration from being transmitted to the main cleaner assembly 3 and the floor nozzle 1, the outer wire 29 is mounted by a vibroisolating member **29*a* to the attachment base 9**.

The power transmitting shaft 24 may be curved in its entirety to keep the inner and outer shafts 28, 29 in contact with each other under a constant force for thereby preventing the inner wire 28 from being vibrated and permitting the same to rotate stably.

Figure 8:
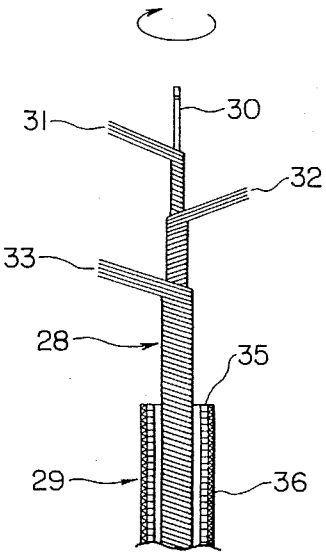
FIG. 8 is an enlarged fragmentary side elevational view, partly in cross section, of a power transmitting shaft, showing the manner in which wires are wound in different layers.
Figure 5:
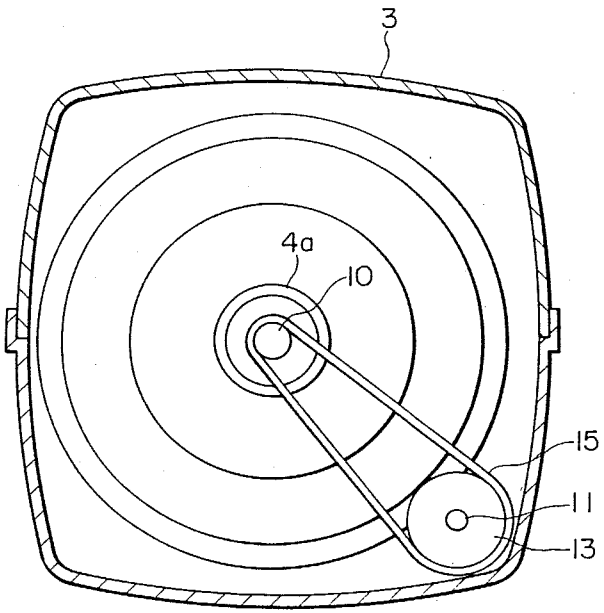
FIG. 5 is an enlarged cross-sectional view taken along line V—V of FIG. 4.

The inner and outer wires 28, 29 of the shaft 24 will be described in greater detail with reference to FIGS. 8 and 9. The inner wire 28 is composed of a core wire 30 in the form of a steel wire having a diameter of 0.34 mm, first-layer winding wires 31 in the form of four parallel steel wires each having a diameter of 0.36 mm and helically wound around the core wire 30, second-layer winding wires 32 in the form of four parallel steel wires each having a diameter of 0.36 mm and helically wound around the first-layer winding wires 31 in close contact therewith in a direction opposite to that in which the first-layer winding wires 31 are helically wound, and third- or outermost-layer winding wires 33 in the form of six steel wires each having a diameter of 0.36 mm and helically wound around the second-layer winding wires 32 in close contact therewith in a direction opposite to that in which the second-layer winding wires 32 are helically wound. The wires of the inner wire 28 are pressed together at one end thereof by an inner wire retainer 34 of a square cross section inserted in the clutch shaft 11 for transmitting rotative power from the clutch shaft 11 to the inner wire 28. However, the inner wire retainer 34 may be dispensed with, and the end of the inner wire 28 may be cross-sectionally shaped at its end for insertion in the clutch shaft 11.

Figure 9:
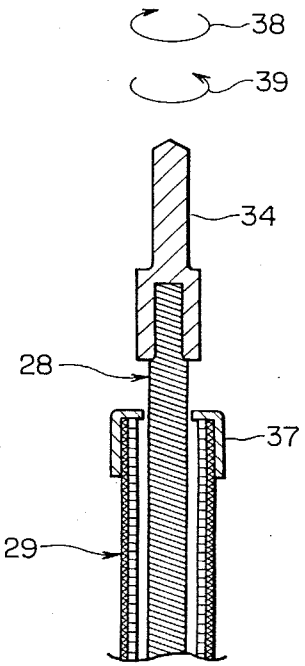
FIG. 9 is an enlarged fragmentary side elevational view, partly in cross section, of the power transmitting shaft.

When the inner wire retainer 34 is rotated about its own axis in the direction of the arrow 38 in FIG. 9, the outermost-layer wires 33 of the inner wire 28 are tightened to produce a torrional force with which a large torque can be transmitted. Therefore, the allowable torque as referred to above can be transmitted by the inner wire 28 when rotating the same in the direction of the arrow 38.

If the inner wire retainer 34 were rotated in the direction of the arrow 39, then the outermost-layer wires 33 would be loosened to reduce the allowable torque which could be transmitted to half. If the inner wire 28 were subjected to a torque greater than the half of the allowable torque, then the outermost-layer wires 33 would be separated from the second-layer wires 32, resulting in a failure to transmit the torque.

The outer wire 29 is composed of an inner tubular core 35 comprising a steel wire of a rectangular cross section helically wound in close contact, a cover 36 of synthetic resin or rubber covering the outer peripheral surface of the core 35, and a cap 37 of metal or synthetic resin mounted on an end of the outer wire 29, the inner wire 28 extending through the cap 37.

Since the inner core 35 comprises a steel wire, it presents a small frictional resistance with respect to the inner wire 28, and can be curved to an arcuate shape of an even radius of curvature. The cap 37 is effective in preventing any leakage of the grease filled in the clearance between the inner wire 28 and the inner core 35 of the outer wire 29. The cover 36 serves to absorb or attenuate vibrations and noise generated upon rotation of the inner wire 28 within the outer wire 29, and also to prevent grease leakage.

The power transmitting shaft 24 can be used for most effective torque transmission when rotated about its own axis in a direction to tighten the outermost-layer wires 33 of the inner wire 28. The power transmitting shaft 24 of the above construction is of a compact design and inexpesnive to manufacture.

Although certain preferred embodiments of the present invention have been shown and described in detail, it should be understood that various changes and modifications may be made therein without departing from the scope of the appended claims.

What is claimed is:

1. A vacuum cleaner comprising:

(a) a floor nozzle housing a rotatable brush therein for cleaning contact with a surface to be cleaned;

(b) an elongated main cleaner assembly directly coupled with said floor nozzle for angular movement with respect thereto and including a motor-driven fan with a motor shaft and a filter in longitudinally spaced relation;

(c) a flexible power transmitting shaft for transmitting rotative power from said motor-driven fan to said rotatable brush, said flexible power transmitting shaft having one end positioned in one end of said floor nozzle and coupled to said rotatable brush and an opposite end portion extending longitudinally in and along one side of said elongate main cleaner assembly remote from said one end of said floor nozzle, said flexible shaft being smoothly curved thereby forming a power transmitting path having a large radius of curvature; and (d) a torque limiter mechanism disposed in said power transmitting path for cutting off power transmission from said motor shaft to said rotatable brush when said rotatable brush is subjected to a torque greater than a preset torque.

2. A vacuum cleaner according to claim 2, including a clutch mechanism in said power transmitting path between said motor shaft and said power transmitting shaft.

3. A vacuum cleaner according to claim 1, wherein said torque limiter mechanism includes a clutch mechanism in said power transmitting path between said motor shaft and said power transmitting shaft.

4. A vacuum cleaner according to claim 2 or 3, wherein said clutch mechanism comprises a clutch shaft mounted on an end of said power transmitting shaft which is closer to said motor-driven fan, a drive pulley fixedly mounted on said clutch shaft, an idler pulley rotatably mounted on said clutch shaft, and a belt trained around said motor shaft and selectively around said drive and idler pulleys.

5. A vacuum cleaner according to claim 4, including a bearing by which said clutch shaft is rotatably journalled, and an attachment base supporting said bearing and mounted on said motor-driven fan.

6. A vacuum cleaner according to claim 5, including an intermediate power transmitting mechanism disposed in said power transmitting path and including said torque limiter mechanism, said intermediate power transmitting mechanism and said power transmitting shaft being disposed in one corner of said main cleaner assembly.

7. A vacuum cleaner according to claim 5, including a clutch mechanism in said power transmitting path between said motor shaft and said power transmitting shaft, said clutch mechanism and said motor-driven fan being mounted in said main cleaner assembly, said power transmitting shaft including a substantial portion disposed outside of said main cleaner assembly, said clutch mechanism and said power transmitting shaft being operatively coupled with each other within said main cleaner assembly.

8. A vacuum cleaner according to claim 5, wherein said power transmitting shaft comprises an inner wire and an outer wire through which said inner wire axially extends, said power transmitting shaft being curved in its entirety to keep said inner wire in contact with said outer wire.

9. A vacuum cleaner according to claim 5, wherein said power transmitting shaft comprises an inner wire and an outer wire through which said inner wire axially extends, said outer wire being mounted in said main cleaner assembly and said floor nozzle through vibroisolating means.

10. A vacuum cleaner according to claim 5, wherein said power transmitting shaft comprises an inner wire and an outer wire through which said inner wire axially extends, said inner wire including helically wound outermost-layer wires and rotatable about its own axis in a direction to tighten said outermost-layer wires for transmitting power through said power transmitting shaft.

11. A vacuum cleaner according to claim 2 or 3, including a lever operatively mounted on said main cleaner assembly for actuating said clutch mechanism.

12. A vacuum cleaner according to claim 2 or 3, wherein said clutch mechanism can be actuated from outside of said main cleaner assembly.

13. A vacuum cleaner according to claim 2 or 3, wherein said main cleaner assembly includes a grip having a control lever for actuating said clutch mechanism.

14. A vacuum cleaner according to claim 2 or 3, wherein said motor-driven fan is energized and de-energized in response to operation of said clutch mechanism.

15. A vacuum cleaner according to claim 1, wherein said power transmitting shaft is curved.

16. A vacuum cleaner according to claim 1, wherein said torque limiter mechanism comprises a first pulley fixed to said power transmitting shaft, a second pulley fixedly coupled to said rotatable brush, and a flat belt trained around said first and second pulleys.

17. A vacuum cleaner comprising:

(a) a floor nozzle housing a rotatable brush therein for cleaning contact with a surface to be cleaned;

(b) a main cleaner assembly coupled with said floor nozzle and including a motor-driven fan with a motor shaft and a filter;

(c) a flexible power transmitting shaft for transmitting rotative power from said motor-driven fan to said rotatable brush along a power transmitting path between said motor shaft and said rotatable brush; and (d) first means for connecting an upper end of the flexible shaft to the motor shaft; and (e) second means for connecting a lower end of the flexible shaft to the rotatable brush, said second means including a driven shaft connected coaxially to the flexible shaft and mounted within the floor nozzle generally parallel to the brush, said upper end of the flexible shaft extending generally orthogonally to the lower end of the flexible shaft.

18. The vacuum cleaner of claim 17, wherein said vacuum cleaner is an upright vacuum cleaner, said main cleaner extending upwardly from the floor nozzle and being pivotal in relation to the nozzle about a generally horizontal axis of rotation connecting the main cleaner to the nozzle.

19. The vacuum cleaner of claim 17, wherein a longitudinal axis of the main cleaner assembly generally bisects the floor nozzle, the lower end of the flexible shaft being located on one side of the axis at one end of the floor nozzle, the upper end of the flexible shaft and the other end of the nozzle being located on the other side of the axis.

20. The vacuum cleaner of claim 17 wherein said flexible shaft is smoothly curved along an entire length thereof.

21. A vacuum cleaner comprising:

(a) a floor nozzle housing a rotatable brush therein for cleaning contact with a surface to be cleaned;

(b) a main cleaner assembly directly coupled with said floor nozzle for angular movement with respect thereto about an axis of rotation and including a motor-driven fan with a motor shaft and a filter;

(c) a flexible power transmitting shaft for transmitting rotative power from said motor-driven fan to said rotatable brush along a power transmitting path between said motor shaft and said rotatable brush; and (d) a torque limiter mechanism disposed in said power transmitting path for cutting off power transmission from said motor shaft to said rotatable brush when said rotatable brush is subjected to a torque greater than a preset torque.

* * * * *